United States Patent [19]

Ishimaru et al.

[11] 4,142,670

[45] Mar. 6, 1979

[54] CHYLOMICRON ROTOR

[75] Inventors: Kenzo Ishimaru, San Jose; Lee Gropper, Los Altos Hills, both of Calif.

[73] Assignee: Beckman Instruments, Inc., Fullerton, Calif.

[21] Appl. No.: 873,171

[22] Filed: Jan. 27, 1978

[51] Int. Cl.[2] ..... B04B 1/06

[52] U.S. Cl. ..... 233/20 R

[58] Field of Search ..... 233/20 R, 1 R, 1 A, 233/14 R, 27, 28, 46, 47 R

[56] References Cited

U.S. PATENT DOCUMENTS

| | | | |
|---|---|---|---|
| 3,096,283 | 7/1963 | Hein | 233/20 R |
| 3,239,136 | 3/1966 | Hein | 233/20 R |
| 3,244,363 | 5/1966 | Hein | 233/20 R |
| 4,056,225 | 11/1977 | Hein | 233/20 R |

*Primary Examiner*—George H. Krizmanich

*Attorney, Agent, or Firm*—R. J. Steinmeyer; F. L. Mehlhoff; W. H. May

[57] ABSTRACT

A centrifuge rotor assembly having a resilient liner with at least two separate chambers. Fluid communication between the separate chambers is automatically controlled in response to centrifugation operation of the rotor. When the rotor is stationary, the liner assumes a first position within the rotor where an annular chamber is sealed from a central chamber. When a fluid sample is placed within the liner of the rotor and the rotor is subjected to centrifugation, the centrifugally induced forces of the fluid mixture shift the liner to a second position, opening the sealed condition between the central and annular chambers to permit fluid communication between the respective chambers. When the centrifugation operation has been completed and the rotor returns to its stationary position, the inherent resilient structural characteristics of the liner automatically reestablish the seal between the respective chambers.

5 Claims, 5 Drawing Figures

CHYLOMICRON ROTOR

BACKGROUND OF THE INVENTION

This invention relates generally to centrifuges for separating constituents of a fluid mixture and, more particularly, relates to a centrifuge rotor which automatically isolates the separated constituents from the fluid mixture in a sealed chamber to prevent possible remixing with the remainder of the fluid mixture after the completion of the centrifugation operation.

By exposing certain fluid mixtures to very high speeds of rotation in a centrifuge it is possible to separate out various constituents of the mixture. An incident problem with the centrifugation operation relates to the possible remixing of the various separated constituents during the time that the rotor is decelerating to a complete stop from its high rotational speed. Consequently, various arrangements have been devised, such as shown in U.S. Pat. Nos. 3,239,136, 3,096,283 and 4,056,225 issued to George N. Hein, for sealing the separated fluid constituents in an annular chamber.

In the first two above-referenced patents the arrangements utilized to accomplish the sealing function are quite complicated and contribute to a more costly device. In addition, these two prior art arrangements do not operate automatically in response to the centrifugation operation to provide for both the automatic sealing and unsealing of the annular chamber. Although the U.S. Pat. No. 4,056,225 patent does provide for an automatic sealing and unsealing of the annular chamber during centrifugation, it utilizes a separate sealing element which contributes to the overall size of the rotor, as well as constituting a separate element in the rotor, representing an additional cost to the overall manufacture of the rotor.

SUMMARY OF THE INVENTION

The present invention comprises a resilient rotor liner having a central chamber and an annular chamber designed to receive a fluid mixture for subjection to centrifugation. The unique configuration of the rotor liner is such that when it is placed within a rotor it will automatically, in response to the centrifugation forces, unseal and seal the annular chamber from the central chamber. The liner is designed so that the removable cap portion of the rotor will force the upper portion of the liner into engagement with an annular junction in the lower portion of the liner and form an annular seal between the annular chamber and the central chamber of the liner. When the rotor is stationary, there is a gap between the bottom of the liner and the bottom of the cavities in the rotor to permit movement of the lower portion of the liner. During centrifugation the centrifugally induced forces of the fluid mixture will move the lower portion of the liner toward the bottom of the rotor resulting in a gap between the annular junction in the lower liner portion and an upper portion of the liner to permit fluid communication between the annular chamber and the central chamber.

When centrifugation is completed and the rotor returns to its stationary position, the inherent resilience of the prebiased structural configuration in the liner will cause the lower portion of the liner to automatically move the annular junction in the lower portion of the liner in contact with the upper portion of the liner. This movement will occur when the inherent resilient structural forces of the liner are greater than the forces induced by the centrifugated fluid sample.

Consequently, the higher specific gravity constituents of the fluid mixture placed within the liner can flow from the central or inner chamber toward the outer or annular chamber during the centrifugation operation. The constituents with a lower specific gravity than the fluid will accumulate toward the central portion of the rotor and become situated within the central chamber. This cross flow between the respective chambers is allowed by the automatic opening of the seal between the chambers as a result of the centrifugally induced force exerted by the fluid mixture in the liner against the lower portion of the liner. As the rotor slows to a stop subsequent to the centrifugation operation, the centrifugally induced force by the fluid mixture in the liner is eliminated, resulting in the resealing of the annular chamber from the inner chamber by the prebiased forces within the preformed resilient liner element. Consequently, the higher specific gravity fluid constituents will be isolated and sealed in the annular chamber. Thus, the present invention provides for the automatic sealing and unsealing between the annular and inner chambers of the rotor container through the use of an uncomplicated and inexpensive device.

DETAILED DESCRIPTION OF THE INVENTION

Figure 1:
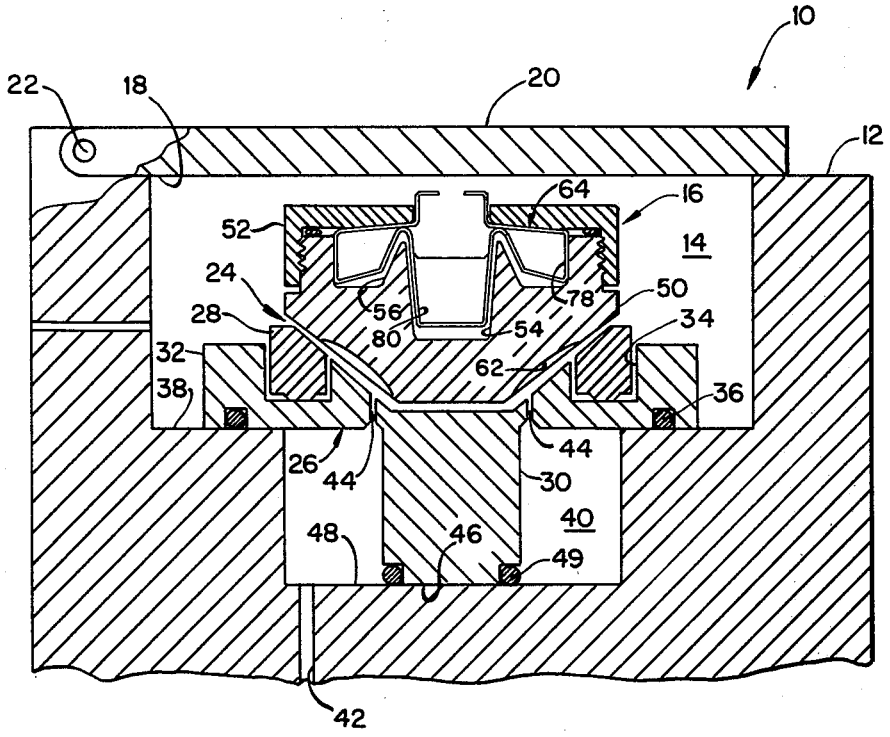
FIG. 1 is a sectional elevation view of the centrifuge apparatus.

The overall centrifuge arrangement 10 is shown in somewhat schematic form in FIG. 1, having a housing 12 with a rotor chamber 14 formed within the housing for receipt of the rotor 16. The upper opening 18 of the housing 12 is enclosed by a cover 20 hinged at a pivot pin 22. The rotor 16 is situated in the rotor chamber 14 on a rotor seat 24 comprised of a stator body 26 and a stator pad 28. The stator body has a central depending portion 30 and an annular portion 32. The stator pad 28 is positioned to be movable or free-floating within a cavity 34 of the stator body annular portion 32. Located below the annular portion 32 of the stator body is an O-ring seal 36 which seals the stator body to the bottom 38 of the chamber 14.

Positioned between the stator body central depending portion 30 and the housing 12 is an annular manifold 40 which is in fluid communication with a driving air passage 42. A plurality of driving air jets 44 are located within the stator body 26 and are in fluid communication with the annular manifold 40. These air jets 44 direct driving air on the rotor to spin the rotor. Bottom 46 of the central depending portion 30 of the stator body 26 is sealed adjacent the bottom 48 of the manifold 40 by an O-ring seal 49.

Figure 2:
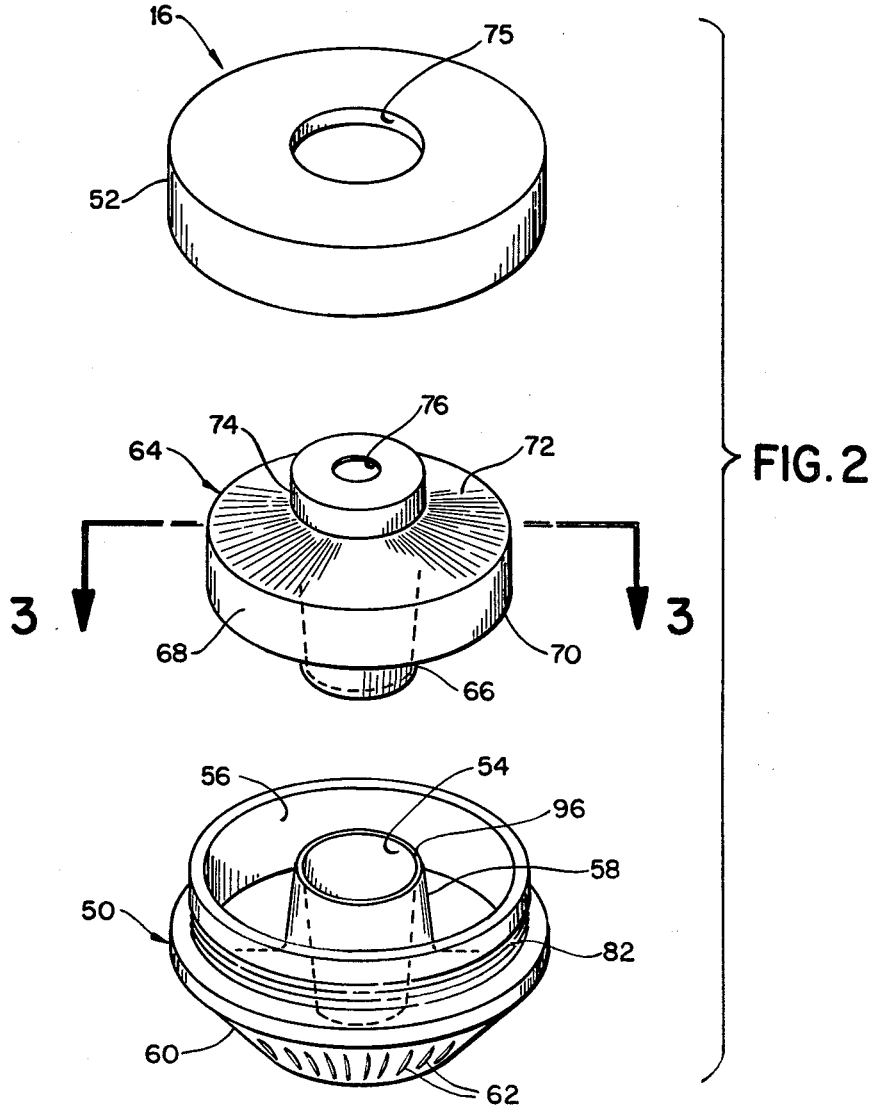
FIG. 2 is an exploded perspective view of the components of the centrifuge rotor.

As shown in FIG. 2, the rotor assembly 16 is comprised of a lower section 50 and an upper section or cover 52. The lower section has a central cavity 54 and an annular cavity 56 which are separated by a circular wall 58. At the bottom 60 of the lower section 50 are a series of air vanes or flutes 62 designed to receive impinging air from the air jets 44 in FIG. 1 to drive the rotor in a rotational manner during centrifugation.

Figure 3:
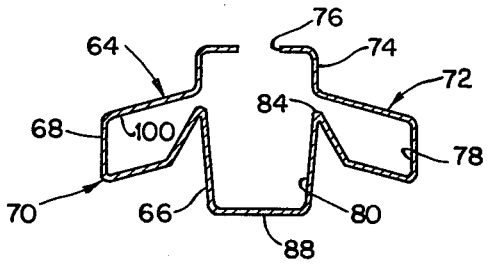
FIG. 3 is a sectional view taken along the lines 3—3 in FIG. 2.

The central cavity 54 and annular cavity 56 in the lower section 50 of the rotor are designed to receive a rotor liner 64 with its respective central part 66 and annular part 68. The liner 64 has a bottom portion 70 and a top portion 72. In the center of the top portion 72 of the liner is a raised central area 74 having an opening or access port 76 to allow access to the interior of the liner 64. Preferably the liner, as shown in FIG. 3, is made from one integral part, so that sealed junctions are eliminated to inhibit potential leakage during centrifugation. The annular chamber 78 which is located within the annular part 68 of the liner is in fluid communication with the central chamber 80 of the central part 66 when the liner is in its unrestrained condition as shown in FIG. 3. The central portion 74 of the liner is raised, so that access is easier through the central opening 76 by the use of a pipette to insert a fluid sample into the annular chamber 78. The aperture 75 in the rotor cover 52 in FIG. 2 accommodates the central portion 74 of the liner.

Figure 4:
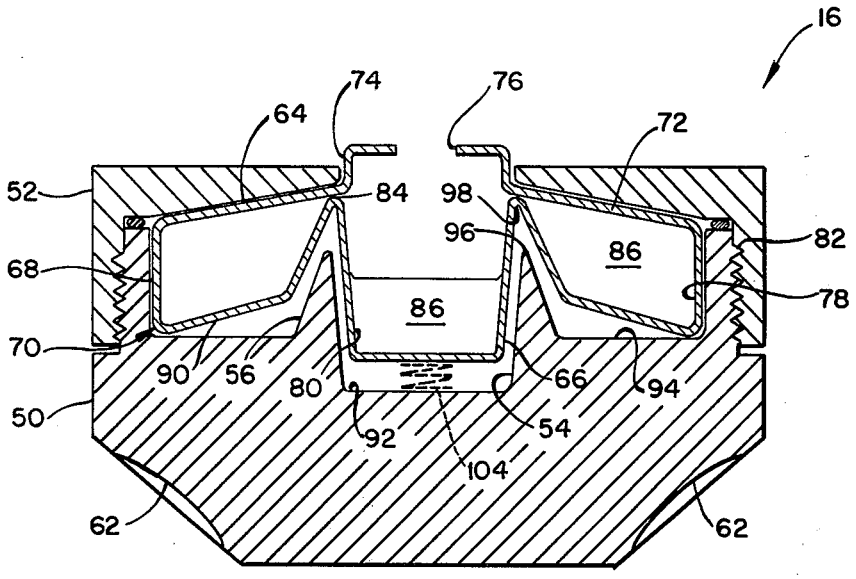
FIG. 4 is a sectional view of the rotor showing the sealed orientation of the respective chambers when the rotor is stationary.

FIG. 4 shows the rotor assembly in its stationary condition. The rotor liner 64 has its central part 66 and its annular part 68 positioned in the respective cavities 54 and 56 of the lower section 50 of the rotor. When the rotor upper section or cover 52 is secured to the lower section 50 of the rotor by the threaded connection 82, the upper portion 72 of the liner is compressed toward and in contact with the annular junction 84 in the lower portion 70 of the liner. The annular junction 84 is at the top of the double wall separation between the central chamber 80 and the annular chamber 78. Consequently, the annular chamber 78 is sealed from the central chamber 80 when the rotor assembly 16 is assembled as shown in FIG. 4 and the rotor is stationary. The fluid mixture 86 in the annular chamber is sealed from any of the fluid mixture 86 within the central chamber 80.

It should be noted that the bottom 88 of the central part 66, as well as the bottom 90 of the annular part 68, are spaced from the respective bottoms 92 of the central cavity 54 and the bottom 94 of the annular cavity 56. There is a space between the top 96 of the wall 58 separating the cavities 54 and 56 and the recessed junction 98 formed between the central part 66 and the annular part 68.

Figure 5:
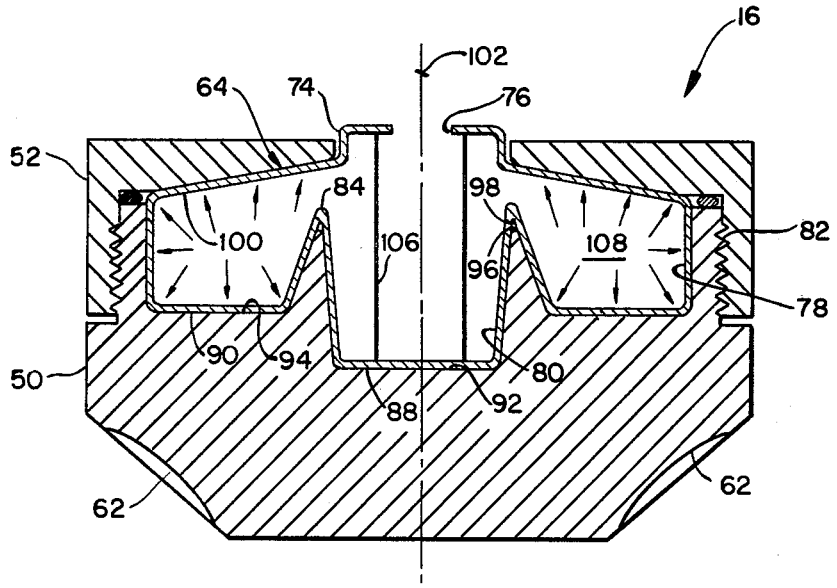
FIG. 5 is a sectional view of the rotor similar to that in FIG. 4, showing the seal between the respective chambers opened to allow fluid communication between the chambers during centrifugation of the rotor.

During centrifugation in FIG. 5 the fluid mixture will exert forces throughout the interior surface 100 of the liner 64 as the rotor rotates about the spin axis 102. These forces are centrifugally induced and wherever the flexible liner 64 is not restrained by the interior configuration of the rotor 16, the liner 64 will flex until it reaches a solid restraining barrier. Therefore, with respect to the liner 64 in FIG. 5, the centrifugally induced forces against the interior surface 100 of the liner 64 will result in the lower portion 70 of the liner being flexed downward in a direction generally parallel to the spin axis 102 toward the respective bottoms 92 and 94 of the central cavity 54 and annular cavity 56. When the lower portion 70 of the liner moves from its orientation in FIG. 4 to its orientation as shown in FIG. 5 as a result of the centrifugally induced forces of the fluid mixture during centrifugation, the annular junction 84 on the walls separating the respective central and annular chambers will move away from the top portion 72 of the liner. As a result, a gap will exist between the annular junction 84 and the upper portion 72 of the liner, permitting fluid communication between the annular chamber 78 and the central chamber 80. Consequently, during centrifugation the entire fluid mixture is free to move between the respective chambers, so that when it is desired, for example, to remove the chyle from blood serum, the lighter chyle 106 will accumulate in the central chamber 80 while the heavier serum material 108 of the blood will accumulate in the annular chamber 78.

Once the centrifugation process has been completed and the rotor returns to its stationary position, the preflexed or prebiased form of the resilient liner 64 will cause the liner to return to its biased position as shown in FIG. 4, causing an automatic seal between the annular chamber 78 and the central chamber 80. The automatic resealing occurring between the annular junction 84 and the upper portion 72 of the liner will prevent any remixing between the separated serum material located in the sealed annular chamber 78 and the chyle material located in the central chamber 80 during any unstable movement of the rotor as it decelerates to its stationary position. Once the rotor has reached its stationary position, the cyle may be removed from the central chamber 80 through the opening 76. The top section or cover 52 of the rotor can be removed from the lower section 50 which will result in the upper portion 72 of the liner expanding upward to its orientation shown in FIG. 3. A pipette can then be inserted through the opening 76 into the annular chamber 78 through a gap which would exist between the annular junction 84 and the upper portion 72 of the liner to extract the separated serum.

In an alternate embodiment, it may be desirable to include a spring member 104, shown in phantom in FIG. 4, in order to ensure that the liner 64 returns to its orientation as shown in FIG. 4 after centrifugation. Preferably, the liner will be constructed of a polyolefin polymer, having the desired resilience. However, other materials of suitable springiness can be used to make the liner. If it is desirable to use material of less suitable springiness, the alternate embodiment of using a spring 104 shown in FIG. 4 in phantom would be necessary.

What is claimed is:

1. A rotor assembly for use with a centrifuge, said rotor comprising:

a bottom rotor section having at least two cavities;

a top rotor section removably attached to said lower rotor section; and a rotor liner having a lower portion and an upper portion, said lower portion having a central chamber and an annular chamber for receipt of a fluid sample, said liner being positioned within said bottom rotor section, said central and annular chambers forming a annular sealing junction within said liner against which the upper portion of said liner is compressed when said top rotor section is secured to said bottom rotor section, said lower portion of said liner being spaced from the bottom of said cavities when said rotor is stationary, said lower portion of said liner being flexed toward said bottom of said cavities when said rotor is spinning so that said annular sealing junction moves away from said upper portion of said liner to establish fluid communication between said chambers.

2. A rotor assembly as defined in claim 1, wherein said liner is sufficiently flexible and resilient to cause said annular sealing junction of said liner to return to its orientation in contact with said upper portion of said liner to seal said annular chamber from said central chamber as said rotor decelerates to its stationary position.

3. A rotor assembly as defined in claim 1, wherein said liner comprises an integral one piece member.

4. A rotor assembly as defined in claim 1 and additionally comprising means for moving said lower portion of said liner toward said upper portion of said liner.

5. A rotor assembly as defined in claim 4, wherein said moving means comprises a spring member located between the bottom of one of said cavities and the bottom of said central chamber of said liner.

* * * * *